United States Patent [19]

Creamer

[11] 4,125,656

[45] Nov. 14, 1978

[54] ABSORBENT PAD FOR TOILET BASE

[76] Inventor: Adelene B. Creamer, 137 Palmer Ave., Mountain View, Calif. 94040

[21] Appl. No.: 372,379

[22] Filed: Jun. 21, 1973

Related U.S. Application Data

[63] Continuation of Ser. No. 121,671, Mar. 8, 1971, abandoned.

[51] Int. Cl.[2] ..... B32B 3/02; B32B 3/28; C09J 7/02; E03D 11/00

[52] U.S. Cl. ..... 428/80; 4/252 A; 428/181; 428/343

[58] Field of Search ..... 156/226, 227, 474; 229/DIG. 3; 206/63; 150/52 K, 52 R; 160/348; 161/99-107, 131, 132; 4/244, 252 A; 428/163, 167, 171, 172, 176, 181, 80, 343

[56] References Cited

U.S. PATENT DOCUMENTS

| | | | |
|---|---|---|---|
| 1,927,913 | 9/1933 | Bennett | 150/52 K |
| 2,575,898 | 11/1951 | Tadinger | 161/99 |
| 2,642,182 | 6/1953 | Baynes | 206/63 |
| 2,771,613 | 11/1956 | Markiewicz | 4/252 A |
| 2,897,108 | 7/1954 | Harwood | 161/129 |
| 3,654,059 | 4/1972 | Zisblatt | 161/149 |

*Primary Examiner*—George F. Lesmes
*Assistant Examiner*—Daniel R. Zirker
*Attorney, Agent, or Firm*—Townsend and Townsend

[57] ABSTRACT

A disposable, absorbent pad adapted to be formed into a U-shaped configuration and to be placed at least partially about the base of a toilet to absorb moisture gravitating near such base. The pad is adjustable and can be provided with a water-proof backing as well as means for adhesively bonding the same to the floor. Several embodiment of the pad are disclosed.

4 Claims, 9 Drawing Figures

FIG.1
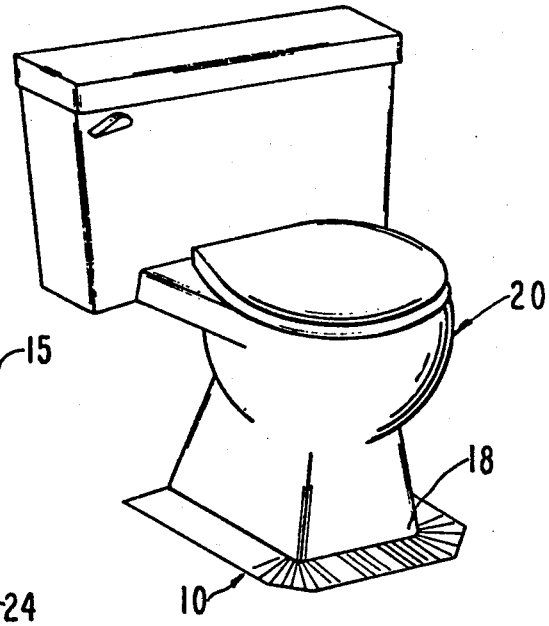
FIG.9
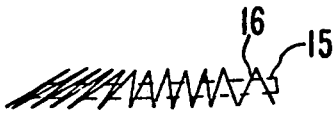
FIG.8
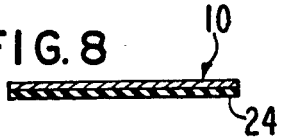
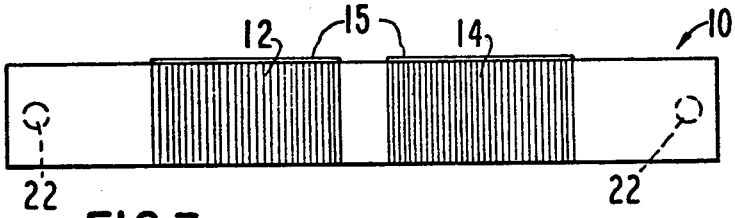
FIG. 2
FIG.3
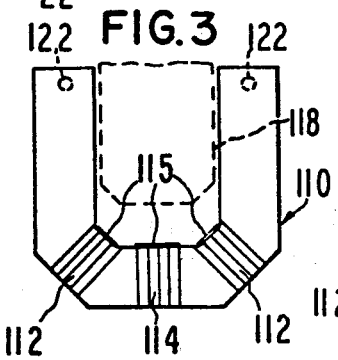
FIG.4
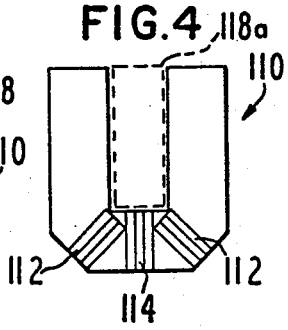
FIG.5
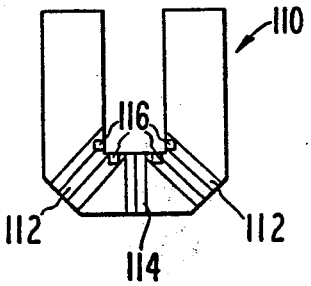
FIG.6
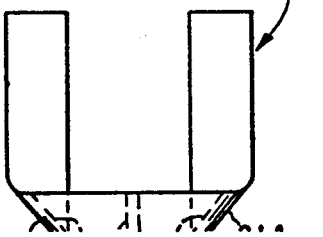
FIG. 7
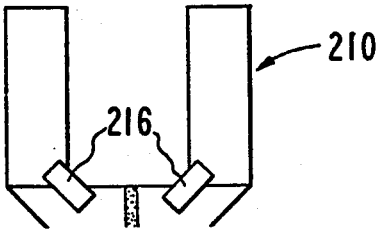

ABSORBENT PAD FOR TOILET BASE

This is a continuation of application Ser. No. 121,671 filed Mar. 8, 1971, now abandoned.

This invention relates to improvements in floor mats or pads of the type for protecting the floor area around the base of a toilet.

The present invention is directed to solving the problem of moisture accumulation around the base of a toilet wherein such moisture leaves an unsightly appearance and oftentimes renders the area unsanitary. The problem arises, in the first instance, due to condensation of water on the outer surface of a toilet, the water gravitating to the base of the toilet and then onto the floor surrounding the base. The problem also arises when children use the toilet, especially boys, who are not careful to use the toilet properly. In either case, the accumulated moisture is clearly undesirable and, while attempts have been made in the past to solve such problem, such attempts, for the most part, have been directed to the use of pads which are bulky, are not disposable, or are not sufficiently adjustable to render the same usable with toilets having bases of different sizes.

The present invention is directed to a disposable, absorbent pad, preferably of paper or the like to keep its cost at a minimum. One form of the invention includes a pad initially in an elongated condition and provided with means permitting it to be formed into a substantially U-shaped configuration. Another form of the invention includes a pad initially provided with a U-shaped configuration. Either form of the invention can readily be placed at least partially about the base of a toilet. Moreover, each form of the pad is adjustable so that it can fit toilet bases of different sizes and configurations. It can also be provided with a waterproof backing layer which engages the floor or other surface therebeneath and which retains moisture in the pad. The simplicity of the invention renders it readily usable and also quickly disposable and thereby provides an inexpensive means of protecting the surface around the base of the toilet yet it is universally adaptable for use with toilet bases of different sizes.

The primary object of this invention is to provide an improved absorbent pad having a U-shaped configuration and adapted to be positioned for absorbing moisture associated with the base of a toilet wherein the pad is formed from relatively inexpensive materials which can be folded or otherwise deformed to render the pad adjustable so as to adapt it for use with toilet bases of different sizes and configurations while permitting the pad to be disposable after use.

Another object of this invention is to provide a pad of the type described wherein the same is either initially elongated or initially U-shaped and may be provided with means for anchoring the same to the floor and also provided with a waterproof backing so that the pad will remain in an operative position and will retain moisture therein during use yet the pad is readily disposable to quickly eliminate unsightly and unsanitary appearances for the floor around the base of the toilet.

Other objects of this invention will become apparent as the following specification progresses, reference being had to the accompanying drawing for an illustration of several embodiments of the invention.

In the drawings:

FIG. 1 is a perspective view of a toilet having one form of the pad of this invention disposed adjacent to its base;

FIG. 2 is a top plan view of one embodiment of the pad before the same is moved into its operative position near the base of the toilet;

FIG. 3 is a top plan view of a second form of the pad of this invention, the pad being initially U-shaped and provided with pleats for adjustment in size;

FIG. 4 is a view of the pad of FIG. 3 but showing the pad in a different shape;

FIG. 5 is a view similar to FIG. 4 but showing the opposite face of the pad of FIG. 4;

FIGS. 6 and 7 are views similar to FIGS. 4 and 5 but illustrating a third embodiment of the pad;

FIG. 8 is a fragmentary, cross-sectional view of the pad showing a waterproof backing thereon; and FIG. 9 is a fragmentary, schematic view of a pleated area of a portion of the pad of either of the first and second embodiments.

The first embodiment of the present invention is illustrated in FIGS. 1–3 and includes an absorbent pad 10 from an initially elongated sheet of absorbent paper material and pleated to provide at least a pair of pleated areas 12 and 14 with each of these areas having a number of pleats 16 of the type shown in FIG. 9. The pleated character of the pad allows the same to be adjusted as to size after the pad has been manipulated or bent into a U-shaped configuration of the type shown in FIG. 2. This can be accomplished by allowing the ends of the pleats on the inner periphery of the U-shape to be compressed and sealed by suitable means as the opposite ends of the pleats are allowed to fan out. The sealing means can, for purposes of illustration, be a flexible tape 14 adhesively bonded to the end faces of the pleats of areas 12 and 14. Tape 15 being shown in full lines in FIG. 2 before the pad is formed into its U-shaped configuration and being shown in dashed lines in FIG. 9. The tape can be removed, then the inner ends of the pleats are compressed, following which the tape is applied again to the end faces of the compressed pleats to hold them together. Since the tape is flexible, it can conform to the particular configuration of the toilet base and also can make the corresponding ends of the pleats conform as well. In so comforming, the pad can fit snugly around the base 18 of a conventional toilet 20.

In its operative position, the pad will generally be in edge engagement with base 18 so as to absorb any moisutre which gravitates along the front and sidewalls of the base. In the U-shaped configuration of FIG. 1, the pad is essentially flat so that it is readily supported on the floor. The pleated areas 12 and 14 may be sealed at the ends adjacent to base 18 or they can be significantly stiff to prevent any return of the pad from the U-shaped configuration of FIG. 1 to the elongated configuration of FIG. 2. In the alternative, the pad may be provided with gummed areas 22 on the underside thereof whereby the pad can be adhesively bonded to the floor. These gummed areas may be covered with removable protective or cover sheets which can be peeled away when the pad is to be used.

In the operative position of FIG. 1, the pad is disposed snugly against base 18 and is in a position to absorb any moisture which falls into the area occupied by the pad or any moisture which gravitates along the side of base 18. Pad 10 can be of any desired width and, even if it is wide enough to be stepped on by a person using the toilet, the pad will still function in the desired manner. Also, the presence of pleats 16 does not distract from the absorbing characteristics of the pad. In fact, the pleats provide greater surface area for moisture absorption.

After use, the pad can be thrown away and a new pad put into its place. It is a simple matter to shape pad 10 from the elongated configuration of FIG. 2 to the U-shaped configuration of FIG. 1.

The pad is suitable for use with toilets having bases of different sizes inasmuch as the pleated areas 12 and 14 provide an adjustability feature for the pad. While the pad is shown as being merely U-shaped, it is possible that the pad can be of greater length than that shown in FIG. 2, so that the added length can be used to partially or totally extend along the rear portion of base 18. In such a case, the pad can be pleated to permit shaping of the added length to conform to the rear portion of base 18.

As an added feature for the pad, it can be provided with a lower, waterproof backing layer 24 (FIG. 8) so that moisture will not pass through the pad and onto the floor or surface beneath the same. Layer 24 can be of any suitable material and can be applied to the pad in any suitable manner, such as by spraying, brushing or the like. Layer 24 will engage the floor when the pad is in use and will keep moisture in the pad.

Pleated areas 12 and 14 of pad 10 allows the pad to fit toilet bases of different configurations, such as rectangular, hexagonal and the like. As shown in FIG. 1, the toilet base has squared corners; however, the pad can be used on bases having rounded or truncated corners as well.

A second embodiment of the invention is shown in FIGS. 3, 4 and 5 and includes a pad 110 of absorbent paper material which is initially U-shaped such as being cut from a sheet of the material. Pad 110 has a pair of side pleated areas 112 and a central pleated area 114 spaced between areas 112, FIG. 4 illustrating the upper surface of the pad and FIG. 5 illustrating the lower surface thereof. Areas 112 permit the pad to be folded from the elongated configuration to the U-shaped configuration of FIG. 4; whereas, area 114 permits finer adjustability of the pad to a particular toilet base than can be achieved with areas 112. Thus, once the U-shaped configuration is formed, area 114 can be expanded or contracted to cause the opposed sides of the U-shaped pad to conform quickly and easily to the outer surface of the toilet base.

On the underside of pad 110, one or more gummed areas 116 can be provided for each area 112, respectively, each pair of gummed areas 116 being disposed to engage the floor or surface beneath the pad and to hold the pad against movement relative to a toilet base. A pair of gummed areas (not shown) may be provided for central pleated area 114 for the same purpose, if desired. Pad 110 can be provided with a waterproof backing of the type shown in FIG. 8, if desired. A tape 115 can be used on the inner end faces of the pleats of areas 112 and 114 in the same manner as tape 15 for the inner end faces of the pleats of pad 10 described above. FIG. 3 shows tape 115 used on the inner end faces of corresponding pleats for holding the pleats against compression or expansion so as to conform to the outer peripheral configuration of a toilet base 118 having truncated front corners. FIG. 3 also shows the pad before it is moved completely into its operative position with respect to base 118.

FIGS. 4 and 5 illustrate pad 110 after the pleats have been adjusted to cause the pad to fit a toilet base having square corners rather than truncated corners as shown in FIG. 3. In such a case, the pleats of side areas 112 are compressed and the inner ends of the pleats are held together such as by tapes 115. The spacing between the parallel sides of the pad is adjusted by compressing or expanding the pleats of central area 114. Again, the pleats of area 114 can be held by a tape 115. The base to which the pad of FIGS. 4 and 5 conforms is shown in dashed lines in FIG. 4 and is denoted by the numeral 118*a*. Gummed areas 122 can be provided on the normally lowermost face of pad 110 to releasably connect it to the floor or surface therebeneath when the pad is in use.

In use, pad 110 is adjusted as to size so that it will fit the base of a particular toilet. This is accomplished by compressing or expanding the pleats of the pad so that the opposed sides thereof extend along and are in proximity to the sides of the toilet base while allowing the central portion of the pad to extend across and in proximity to the base.

A third embodiment of the pad of this invention is shown in FIGS. 6 and 7 and is denoted by the numeral 210. Pad 210 is initially elongated as shown in FIG. 2 and is formed from a foldable, absorbent material, such as absorbent paper or the like. Because it is foldable, pad 210 is adjustable as to size to fit the base of a particular toilet. It can be folded from the elongated condition to a U-shaped condition as shown in FIGS. 6 and 7. A pair of fold lines 212 and 214 are illustrated to show how the pad can be folded to partially surround the base of a particular toilet. Dashed lines 212*a* and 214*a* show other fold lines near fold lines 212 and 214, respectively, to thereby illustrate how pad 210 is adjustable as to size.

A pair of gummed fasteners 216 may be applied to the underside of pad 210 in the manner shown in FIG. 7 to maintain the U-shaped configuration of the pad as well as to permit the pad to fit a toilet base of a particular configuration. These fasteners may be applied immediately after the pad is formed into the U-shaped configuration. Also, pad 210 may be provided with a gummed area 218 on the underside thereof to permit the pad to be adhesively attached to the floor when the pad is in use.

Pad 210 may be provided with a waterproof, inner layer between opposed outer layers of absorbent paper material. Thus, the pad will be effective to absorb and retain moisture regardless of which side of the same faces inwardly.

Pad 210 is used in the same manner as pads 10 and 110. After use, it can be discarded and replaced by another pad of the same construction.

The present invention provides a U-shaped pad of absorbent material which defines a pair of spaced sides, a central portion interconnecting proximal ends of the sides, and an inner peripheral margin or edge on the inner periphery of the U-shape. The adjustment means of the invention permits not only the spacing between the sides to be varied but also permits the configuration of the inner peripheral edge to be changed. Thus, the pad of this invention can readily be adjusted to fit toilet bases of different sizes and configurations.

I claim:

1. A disposable pad for absorbing moisture adjacent to the base of a toilet comprising: a sheet of absorbent material, said sheet having a substantially U-shaped configuration to present an inner periphery, an outer periphery, a pair of spaced sides, and a central portion interconnecting proximal ends of the sides, whereby the sheet can at least partially surround and conform to the base of a toilet, said sheet having a number of pleats thereon extending through the entire distance between said inner and outer peripheries at the junction of the central portion and each side, respectively, for adjusting the spacing between said sides and for changing the configuration of said inner periphery; and means on the sheet for holding the same against a change in the spacing between the sides and the configuration of said inner periphery.

2. A pad as set forth in claim 1, wherein said sheet is initially elongated, and wherein said pleats are sufficient in number to permit the sheet to be moved from an elongated straight condition to a U-shaped condition.

3. A pad as set forth in claim 1 wherein the sheet is initially U-shaped and has three groups of pleats, one of the pleated groups being on the central portion substantially midway between the sides and the other two pleated groups being at the junction between the central portion and respective sides, the pleats of said one group being movable to adjust the spacing between said sides and the pleats of the other groups being movable to adjust the configuration of said inner periphery.

4. A pad as set forth in claim 1, wherein said pleats have respective, first end faces terminated at said inner periphery, said holding means including a flexible tape releasably secured to the first end faces of at least certain of said pleats.

* * * * *